US007637313B2

(12) United States Patent
Taniguchi et al.

(10) Patent No.: US 7,637,313 B2
(45) Date of Patent: Dec. 29, 2009

(54) HEAT EXCHANGER AND ITS MANUFACTURING METHOD

(75) Inventors: Mitsunori Taniguchi, Shiga (JP); Osao Kido, Kyoto (JP); Toshiaki Mamemoto, Shiga (JP)

(73) Assignee: Panasonic Corporation, Osaka (JP)

( * ) Notice: Subject to any disclaimer, the term of this patent is extended or adjusted under 35 U.S.C. 154(b) by 196 days.

(21) Appl. No.: 10/593,696

(22) PCT Filed: Apr. 12, 2005

(86) PCT No.: PCT/JP2005/007062

§ 371 (c)(1),
(2), (4) Date: Sep. 20, 2006

(87) PCT Pub. No.: WO2005/100896

PCT Pub. Date: Oct. 27, 2005

(65) Prior Publication Data

US 2008/0135218 A1 Jun. 12, 2008

(30) Foreign Application Priority Data

Apr. 14, 2004 (JP) ..... 2004-118621
Feb. 14, 2005 (JP) ..... 2005-035624

(51) Int. Cl.
*F28D 1/03* (2006.01)

(52) U.S. Cl. ..... 165/148; 165/167; 165/170

(58) Field of Classification Search ..... 165/148, 165/153, 165–167, 170
See application file for complete search history.

(56) References Cited

U.S. PATENT DOCUMENTS 2,045,657 A * 6/1936 Karmazin ..... 165/165
5,063,995 A * 11/1991 Forster et al. ..... 165/166
5,086,837 A * 2/1992 Hagemeister ..... 165/170
5,409,058 A * 4/1995 Yuasa et al. ..... 165/167
5,628,363 A * 5/1997 Dewar et al. ..... 165/165
2003/0037908 A1 2/2003 Sugito et al.

FOREIGN PATENT DOCUMENTS

JP 3055130 1/1999
JP 2001-116481 A 4/2001
JP 2003-302176 A 10/2003

* cited by examiner

*Primary Examiner*—Leonard R Leo
(74) *Attorney, Agent, or Firm*—McDermott Will & Emery LLP

(57) ABSTRACT

A heat exchanger which, while having excellent heat exchanging performance, has a structure easy to produce, is of low cost, and has high quality and reliability. The heat exchanger has first base plates (26), in each of which first slits (30) and second slits (40) are provided in substantially parallel to each other, and has second base plates (28), in each of which third slits (50) with substantially the same shape as a first slit (30) are provided. The length in the longitudinal direction of a second base plate (28) is set to be less than the length of a second slit (40). The first base plates (26) and the second base plates (28) are layered over each other such that the first slits (30) provided in the first base plates (26) and the third slits (50) provided in the second base plates (28) are communicated. Flow paths (60) outside tubes are constructed by the first slits (30) provided in the first base plates (26) and the third base plates (50) provided in the second base plates (28). Flow paths (70) inside the tubes are constructed by the second slits (40) provided in the first base plates (26) and the second base plates (28). Since a heat exchanging section formed only by tubes can be constructed by the base plates with the slits, the heat exchanger can be easily produced. Further, the heat exchanger can be provided at low cost.

11 Claims, 27 Drawing Sheets

FIG.27 – *PRIOR ART* –
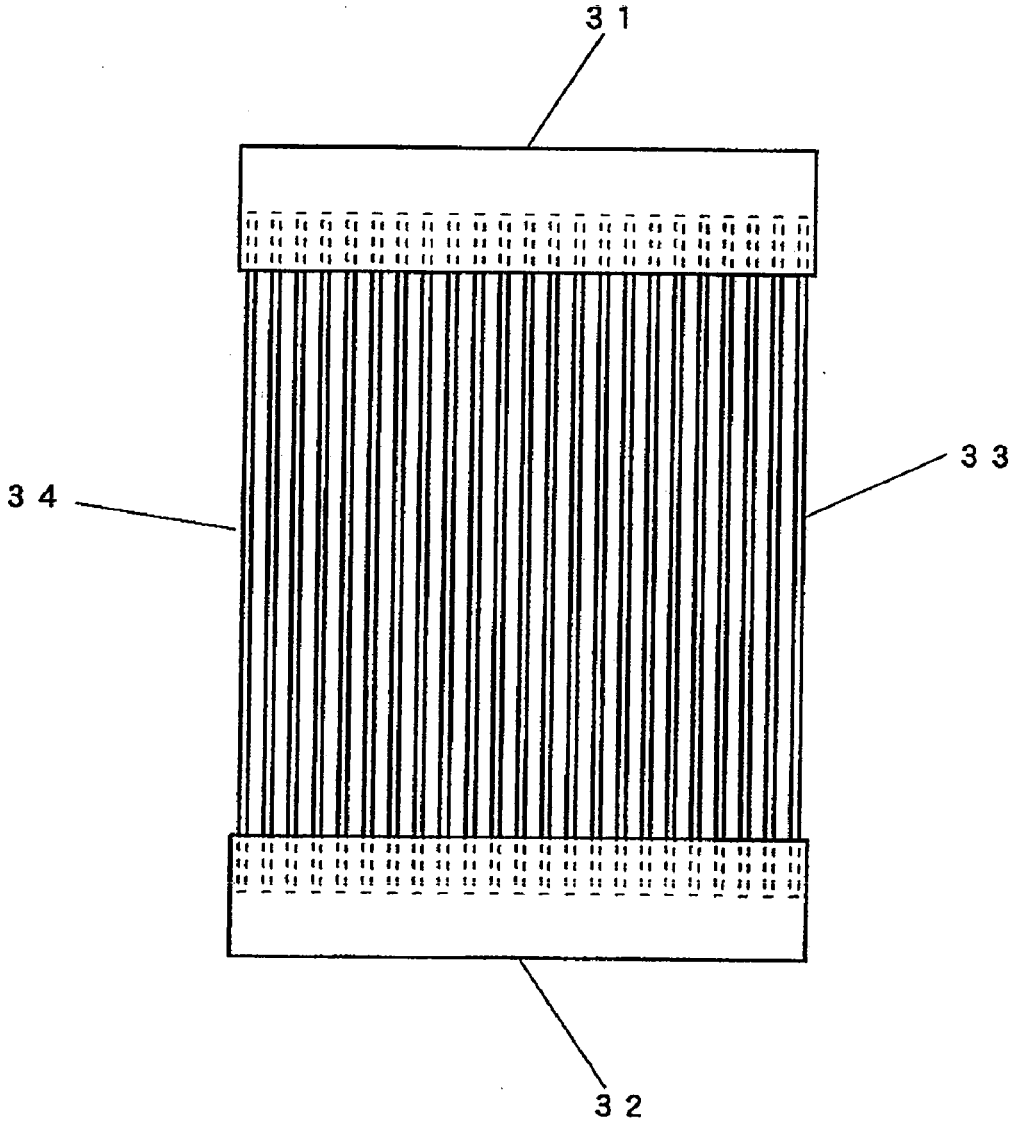

HEAT EXCHANGER AND ITS MANUFACTURING METHOD

RELATED APPLICATIONS

This application is the U.S. National Phase under 35 U.S.C. §371 of International Application No. PCT/JP2005/007062 filed on Apr. 12, 2005, which in turn claims the benefit of Japanese Application No. 2004-118621 filed on Apr. 14, 2004, and Japanese Application No. 2005-035624 filed on Feb. 14, 2005, the disclosures of which Applications are incorporated by reference herein.

TECHNICAL FIELD

The present invention relates to a heat exchanger for a cooling system, a heat radiation system, and a heating system, and more particularly to a heat exchanger of liquid and gas used in a system such as an information device requiring compactness.

BACKGROUND ART

Conventionally, a heat exchanger formed of tubes and fins is generally used. For aiming at compactness, recently, the tube diameter and tube pitch have been decreased, and the tube density has been increased. For example, a heat exchanging section is formed of extremely thin tubes of which outer diameter is about 0.5 mm.

FIG. 27 is a front view of a conventional heat exchanger disclosed in Japanese Patent Unexamined Publication No. 2001-116481. In the conventional heat exchanger, inlet tank 31 and outlet tank 32 are faced to each other at a predetermined interval as shown in FIG. 27. Core section 34 is formed between inlet tank 31 and outlet tank 32, and, in core section 34, a plurality of tubes 33 with annular cross section are disposed and external fluid flows outside tubes 33.

Tubes 33 are arranged in a square grid shape, the outer diameter of tubes 33 is set between 0.2 mm and 0.8 mm inclusive, and the value derived by dividing the pitch between adjacent tubes 33 by the outer diameter is set between 0.5 and 3.5 inclusive. Thus, the heat exchange amount per working power can be significantly increased.

The specific elements and manufacturing method of the conventional heat exchanger are not described. In a generally considered method, however, many thin tubes 33 are prepared, inlet tank 31 and outlet tank 32 of which specific surfaces previously have many small circular holes are prepared, the opposite ends of tubes 33 are inserted into the circular holes in inlet tank 31 and outlet tank 32, and the inserted parts of tubes 33 are bonded to inlet tank 31 and outlet tank 32 by welding or the like. However, for manufacturing the thin circular tubes, a precise processing device is required, and hence the heat exchanger becomes expensive. Further, small circular holes into which tubes 33 are inserted must be disposed in inlet tank 31 and outlet tank 32 at a predetermined fine pitch, and hence it is difficult to perform a process of inserting and bonding tubes 33 to inlet tank 31 and outlet tank 32. Therefore, even when the heat exchanging performance of such a heat exchanger is high, the heat exchanger is extremely expensive, the reliability against the leak of the used fluid is not sufficient, and hence problems remain.

The present invention addresses the conventional problems, and provides a heat exchanger that keeps extremely high heat exchanging performance, has an easy-to-manufacture structure, is inexpensive, and has high reliability.

SUMMARY OF THE INVENTION

In a heat exchanger of the present invention, a plurality of substrates that have a plurality of long plates arranged substantially in parallel, slits disposed between the long plates, and recesses disposed longitudinally continuously in one-side main surfaces of some long plates are stacked. The long plates of adjacent substrates are interconnected to form tubes. The recesses form tube internal flow channels, and the slits form tube external flow channels. Thus, the heat exchanging section including only tubes can be formed on the substrates.

In the heat exchanger of the present invention, substrates and other substrates are alternately stacked. The former substrates have a plurality of long plates arranged substantially in parallel and slits disposed between the long plates. The latter substrates have a plurality of long plates arranged substantially in parallel, slits disposed between the long plates, and recesses disposed longitudinally continuously in one-side main surfaces of long plates. Thus, about half the total number of substrates requires only simple drilling, so that the structure and manufacturing process of the heat exchanger are simplified.

In the heat exchanger of the present invention, holding plates for holding the long plates at their both ends and long holes formed inside the holding plates are disposed on the substrates. The ends of the recesses formed in one-side main surfaces of some long plates communicate with the long holes, and the long holes in adjacent substrates are interconnected, thereby forming branch flow channels. The tube internal flow channels formed of the recesses are connected to the branch flow channels. The substrate where the branch flow channels and tubes are integrated can be thus formed.

In the heat exchanger of the present invention, by setting the thickness of some long plates to be smaller than that of the holding plates, a clearance is formed between the tubes also in the stacking direction of the substrates, and tube external flow channels are formed also between the substrates. Thus, the heat transfer area outside the tubes can be increased, the tube external flow channels can be widened, and flow resistance of the tube external fluid can be suppressed.

In the heat exchanger of the present invention, the fluid in the tube external flow channels is made to flow in the plane direction of the substrates. Therefore, the boundaries between the stacked substrates do not disturb the flow of the tube external fluid.

In the heat exchanger of the present invention, lids for covering the long holes are disposed at both ends of the stacked substrates, and a part of each lid has an inflow tube or an outflow tube. Thus, a part forming a branch flow channel can be used also as the inflow tube or the outflow tube.

In the heat exchanger of the present invention, the substrates are made of resin. The heat exchanger can be thus lightened.

The heat exchanger of the present invention is manufactured by bonding and stacking the substrates by welding.

The substrates are easily bonded to each other without clogging the tube internal flow channels and the tube external flow channels.

In the present invention, the heat exchanging section formed of only tubes can be formed of substrates, so that the heat exchanger can be manufactured using extremely inexpensive components.

In the heat exchanger of the present invention, the branch flow channels can be formed of substrates integrally with the tubes, so that the connection between the tubes and branch flow channels is not required, the process can be further simplified, and the reliability against the leak of liquid and fluid can be improved.

In the heat exchanger of the present invention, a plurality of first substrates and second substrates are stacked. Each first substrate has a plurality of first slits and second slits substantially in parallel. Each second substrate has third slits with substantially the same shape as that of the first slits at substantially the same positions as the projection positions of the first slits, and is shorter than the longitudinal length of the second slits. The first slits and the third slits form tube external flow channels, and the second slits and the second substrates form tube internal flow channels.

Thus, the heat exchanging section formed of only tubes can be formed of substrates having slits, so that the heat exchanger can be relatively easily manufactured.

In the heat exchanger of the present invention, a plurality of first substrates are stacked between second substrates.

Thus, the cross section of the tube internal flow channels can be easily varied by changing the number of stacked first substrates.

In the heat exchanger of the present invention, the tube internal flow channels are enlarged in the substrate stacking direction on an inflow side of external fluid.

Thus, on the inflow side of the external fluid, on which the temperature difference between the external fluid and internal fluid is large and the amount of heat exchange is large, much internal fluid can be made to flow, and efficient heat exchange is allowed. Therefore, the heat exchanger can be further decreased.

In the heat exchanger of the present invention, the inlet and outlet of the tube internal flow channels are extended in the direction of the tube external flow channels. Thus, the opening area of the inlet and outlet of the internal fluid can be increased, the resistance in tube can be reduced, and the flow rate of the internal fluid can be increased. The performance of the heat exchanger can be therefore increased, and hence the heat exchanger can be downsized.

In the manufacturing method of the heat exchanger of the present invention, at least either the first substrates or second substrates are processed by pressing. Thus, the substrates can be manufactured easily and inexpensively.

In the manufacturing method of the heat exchanger of the present invention, at least either the first substrates or second substrates are processed by etching. Thus, even when the interval between the first slit and second slit is shortened, and the wall thickness of the tube internal flow channel is reduced, stress is not applied in manufacturing the slits. The heat exchanger can be therefore, easily manufactured.

In the manufacturing method of the heat exchanger of the present invention, the substrates are bonded together by thermal welding. Thus, the substrates can be easily bonded together without using solder material, the tube internal flow channels are not clogged, and the quality and reliability of the heat exchanger are improved.

In the manufacturing method of the heat exchanger of the present invention, the substrates are bonded together by ultrasonic bonding.

Thus, the material of only the bonding part melts. Therefore, a problem of clogging of the tube internal flow channels by the melting material can be avoided, and hence the reliability of the heat exchanger is further improved.

In the manufacturing method of the heat exchanger of the present invention, the substrates are bonded together by diffusion bonding.

Thus, the material does not melt. Therefore, the tube internal flow channels are not clogged, and hence the reliability of the heat exchanger is further improved.

The heat exchanger of the present invention has an easy-to-manufacture structure, and hence can be provided inexpensively.

The manufacturing method of the heat exchanger of the present invention can provide a heat exchanger that is easy-to-manufacture and has high quality and reliability.

BRIEF DESCRIPTION OF DRAWINGS

FIG. 27 is a front view of a conventional heat exchanger.

REFERENCE MARKS IN THE DRAWINGS

Figure 1:
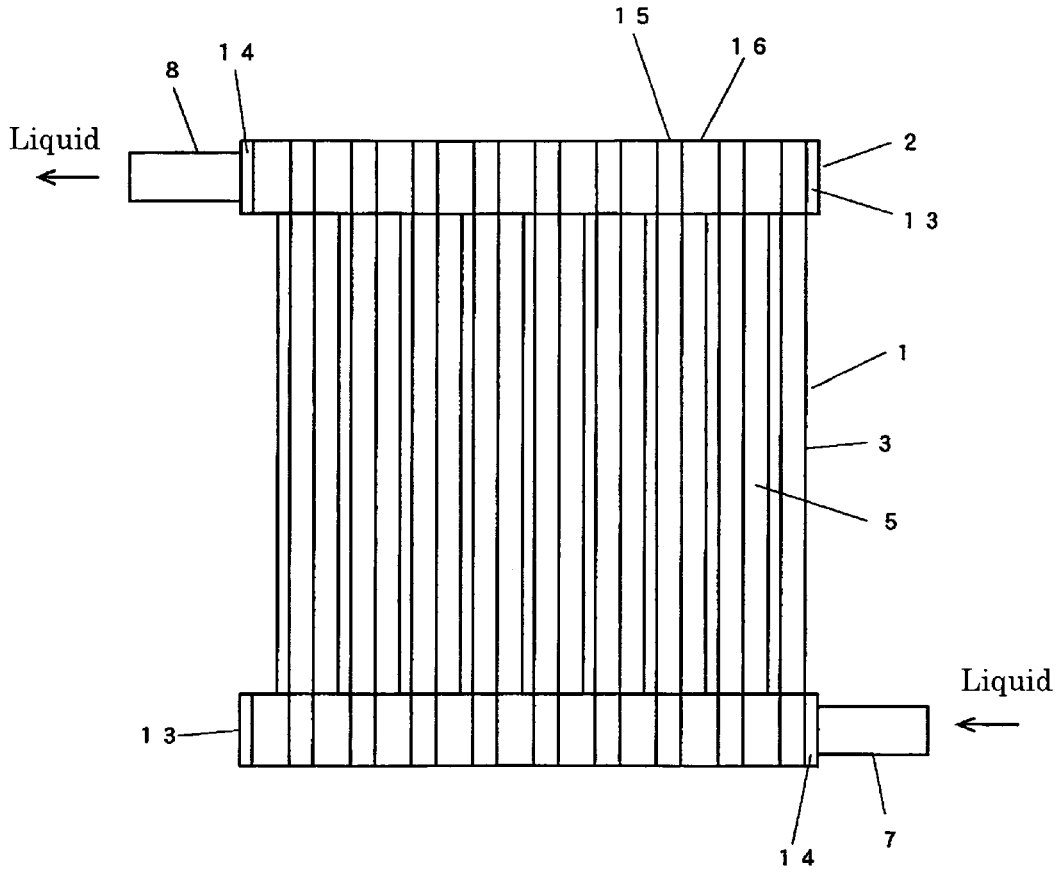
FIG. 1 is a front view of a heat exchanger in accordance with exemplary embodiment 1 of the present invention.

3 Tube
4 Tube internal flow channel
5 Tube external flow channel
6 Branch flow channel
7 Inflow tube
8 Outflow tube
9 Long plate
10 Long plate
11 Long hole
12 Long hole
13 Lid
14 Lid
15 Substrate
16 Substrate
17 Recess
18 Slit
19 Holding plate
20 Slit
21 Holding plate
22 Space
26 First substrate
28 Second substrate
30 First slit
31 Inlet tank
32 Outlet tank
33 Tube
34 Core section
40 Second slit
50 Third slit
60 Tube external flow channel
70 Tube internal flow channel
80 Inlet header
90 Outlet header
126 First substrate
128 Second substrate
130 First slit
140 Second slit
150 Third slit
160 Tube external flow channel
170 Tube internal flow channel
171 Inlet of tube internal flow channel
172 Outlet of tube internal flow channel

DETAILED DESCRIPTION OF PREFERRED EMBODIMENTS

First Exemplary Embodiment

Figure 2:
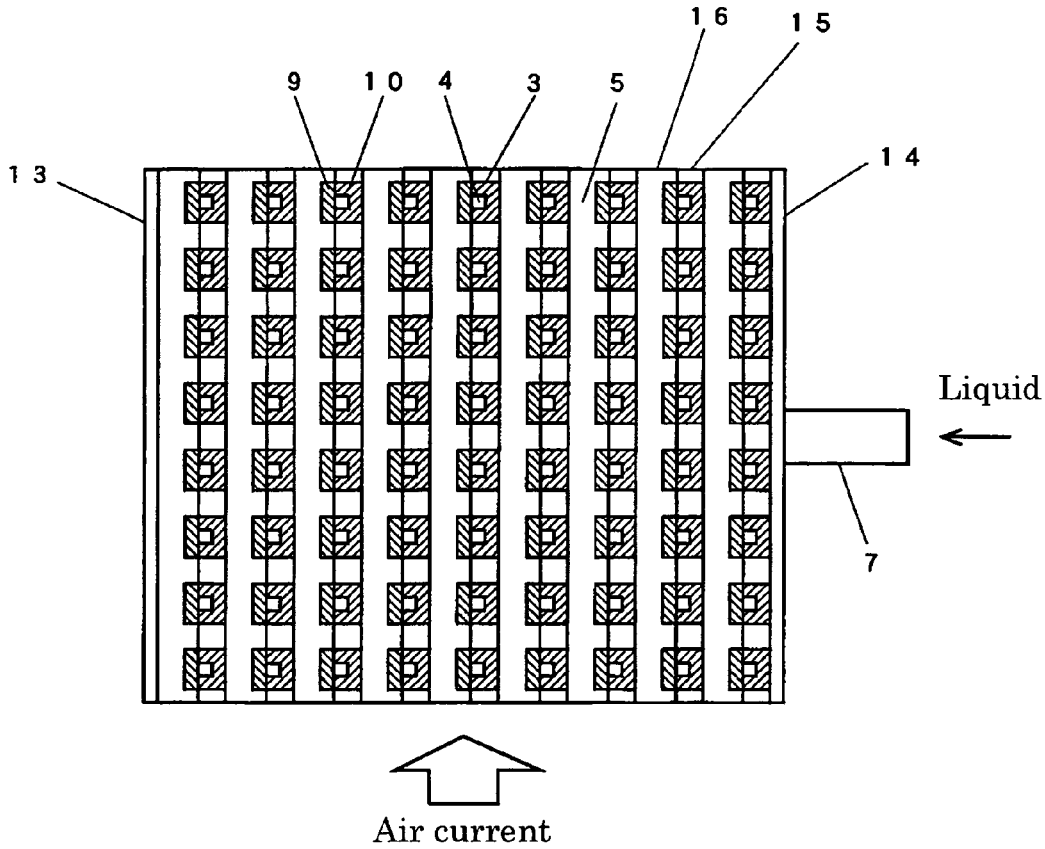
FIG. 2 is a sectional view of the heat exchanger in the direction orthogonal to the tube axis in accordance with exemplary embodiment 1.
Figure 3:
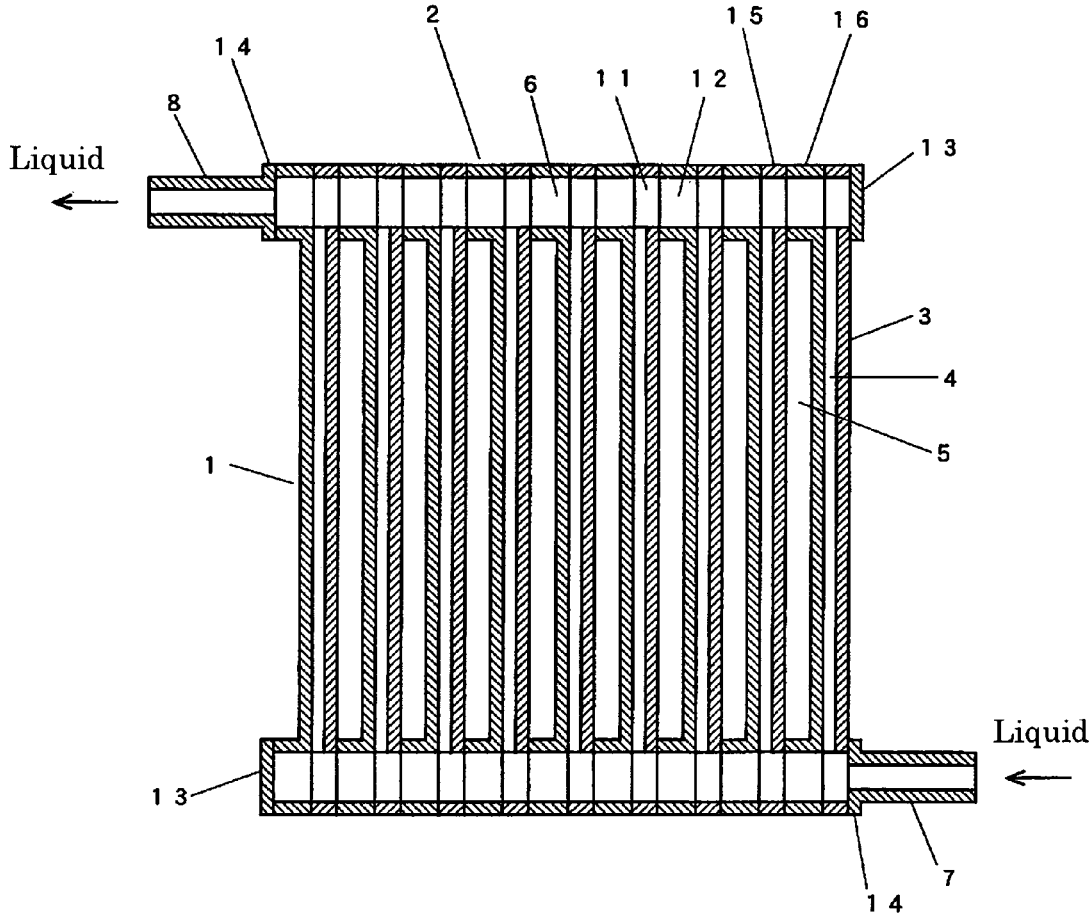
FIG. 3 is a sectional view of the heat exchanger in the tube axis direction in accordance with exemplary embodiment 1.

FIG. 1 is a front view of a heat exchanger in accordance with exemplary embodiment 1 of the present invention. FIG. 2 is a sectional view of a heat exchanging section in the direction orthogonal to the tube axis in the heat exchanger. FIG. 3 is a sectional view of the heat exchanging section in the tube axis direction in the heat exchanger.

In FIG. 1 through FIG. 3, the heat exchanger has heat exchanging section 1, and header sections 2 disposed at opposite ends of heat exchanging section 1. Heat exchanging section 1 has tubes 3 arranged in a grid shape, tube internal flow channels 4, and tube external flow channels 5. Header sections 2 include branch flow channels 6, inflow tube 7, and outflow tube 8. Tube internal flow channels 4 are connected to branch flow channels 6. Each tube 3 has a substantially square cross section, and has band-like long plate 9 and long plate 10 having U-shaped cross section. Each branch flow channel 6 is formed by continuously interconnecting long holes 11 and 12. Flat lid 13 is disposed at one end of branch flow channel 6, and lid 14 having inflow tube 7 or outflow tube 8 is disposed at the other end of branch flow channel 6. This heat exchanger has two kinds of resin-made substrates 15 and 16.

Figure 4:
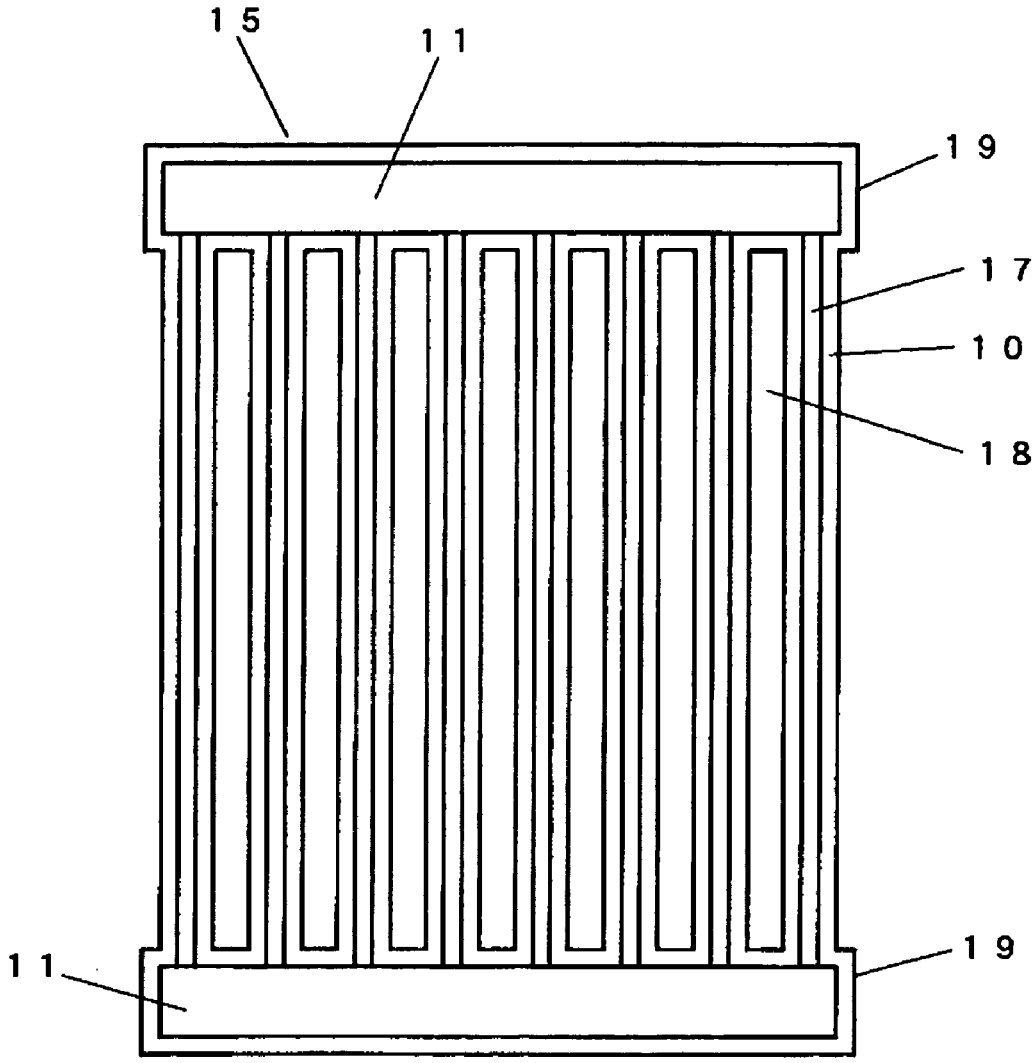
FIG. 4 is a front view of a substrate forming the heat exchanger in accordance with exemplary embodiment 1.
Figure 5:
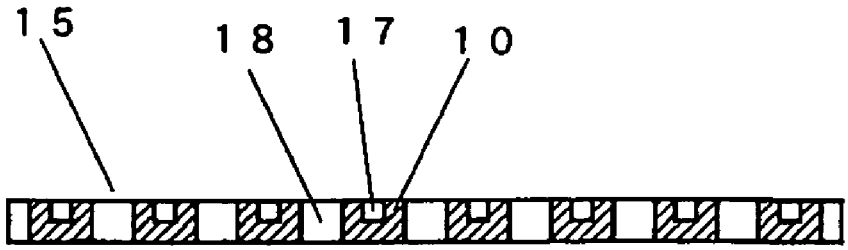
FIG. 5 is a sectional view of the substrate of the heat exchanger in accordance with exemplary embodiment 1.
Figure 6:
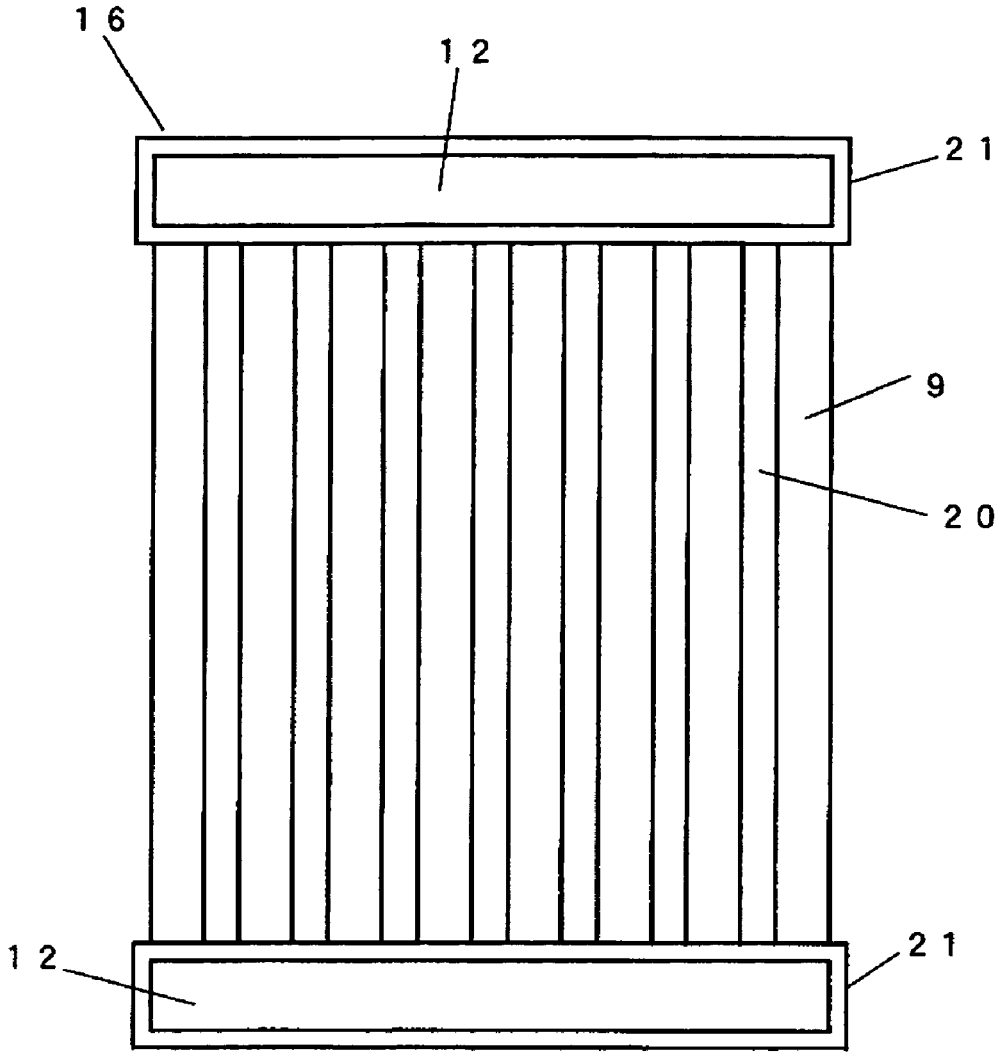
FIG. 6 is a front view of another substrate forming the heat exchanger in accordance with exemplary embodiment 1.
Figure 7:
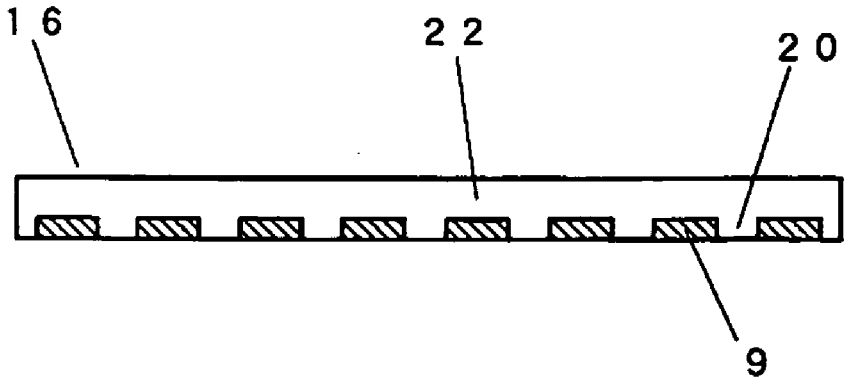
FIG. 7 is a sectional view of the substrate of the heat exchanger in accordance with exemplary embodiment 1.

FIG. 4 is a front view of substrate 15, FIG. 5 is a sectional view of substrate 15, FIG. 6 is a front view of substrate 16, and FIG. 7 is a sectional view of substrate 16.

In FIG. 4 through FIG. 7, recesses 17 are continuously disposed in the longitudinal direction of one main surface of substrate 15. Substrate 15 is formed of a plurality of long plates 10 arranged in parallel, slits 18 disposed between long plates 10, holding plates 19 for holding both longitudinal ends of long plates 10, and long holes 11 disposed inside holding plates 19. Ends of recesses 17 communicate with long holes 11. Substrate 16 is formed of a plurality of flat long plates 9 arranged in parallel, slits 20 disposed between long plates 9, holding plates 21 for holding both longitudinal ends of long plates 9, and long holes 12 disposed inside holding plates 21. Long plates 9 are made thinner than holding plates 21, and space 22 is formed in one-side main surfaces of long plates 9. Substrates 15 and substrates 16 are alternately stacked and welded to form a heat exchanger. Recesses 17 define tube internal flow channels 4, slits 18, slits 20 and spaces 22 define tube external flow channels 5, and long holes 11 and 12 define branch flow channels 6.

In the heat exchanger having this structure, liquid flowing from inflow tube 7 is branched by branch flow channel 6, flows in tube internal flow channels 4, merges in branch flow channel 6, and flows out of outflow tube 8. Air current flows in tube external flow channels 5 in the plane direction of substrates 15 and substrates 16. The liquid and air current are heat-exchanged via tubes 3 in heat exchanging section 1. At this time, substrates 15 and substrates 16 are finely processed, tubes 3 are narrowed, and pitch between tubes 3 can be easily reduced, so that the extremely compact heat exchanger can be easily formed.

In the heat exchanger of embodiment 1, substrates 15 and substrates 16 are alternately stacked. Each substrate 16 has slits 20 between a plurality of long plates 9 arranged in parallel. Each substrate 15 has slits 18 disposed between a plurality of long plates 10 arranged in parallel, and recesses 17 continuously disposed in the longitudinal direction of one-side main surfaces of long plates 10. Long plates 10 and 9 of adjacent substrates 15 and 16 are interconnected to form tubes 3, recesses 17 define tube internal flow channels 4, and slits 18 and 20 define tube external flow channels 5. Thus, heat exchanging section 1 formed of only tubes 3 can be constituted by substrates 15 and 16, and can be manufactured using inexpensive components.

Substrate 16 has slits 20 disposed between the plurality of long plates 9 arranged in parallel, so that substrate 16 requires only simple drilling. Therefore, the heat exchanger can be manufactured in a simple process.

Substrate 15 has also holding plates 19 that hold long plates 10 at both longitudinal ends of long plates 10, and long holes 11 disposed inside holding plates 19. Substrate 16 has holding plates 21 that hold long plates 9 at both ends of long plates 9, and long holes 12 disposed inside holding plates 21. The extended parts of recesses 17 of substrate 15 communicate with long holes 11, long holes 11 and 12 in adjacent substrates 15 and 16 are interconnected to form branch flow channels 6.

Tube internal flow channels 4 defined by recesses 17 are connected to branch flow channels 6. Branch flow channels 6 can be formed of substrates 15 and 16 integrally with tubes 3, so that the connection between the tubes and branch flow channels is not required, the process is further simplified, and the reliability against the leak of liquid and fluid can be improved.

Long plates 9 are made thinner than holding plates 21, and space 22 is formed on one main surface of each long plate 9. Thus, clearances between tubes 3 are disposed also in the stacking direction of substrates 15 and 16, tube external flow channels 5 are disposed between substrates 15 and 16, so that the heat transfer area outside the tubes can be increased, the tube external flow channels can be widened, and flow resistance of the tube external fluid can be suppressed.

The fluid in tube external flow channels 5 is made to flow in the plane direction of substrates 15 and 16, and the boundaries between stacked substrates 15 and 16 do not disturb the flow of the tube external fluid. Therefore, the flow resistance of the tube external fluid can be further suppressed, and adhesion of dust or the like can be prevented.

In the heat exchanger of the present invention, lids 13 and 14 for covering long holes 11 and 12 are disposed at opposite ends of stacked substrates 15 and 16, and inflow tube 7 or outflow tube 8 is disposed in lids 14. In this structure, a part of branch flow channels 6 can be used as inflow tube 7 or outflow tube 8, so that the number of components of the heat exchanger can be reduced and the heat exchanger can be manufactured more inexpensively.

Since both of substrates 15 and 16 are made of resin, the heat exchanger can be lightened.

In this manufacturing method, substrates 15 and 16 are bonded and stacked by welding, so that bonding of substrates 15 and 16 can be easily performed without clogging tube internal flow channels 4 and tube external flow channels 5.

Figure 8:
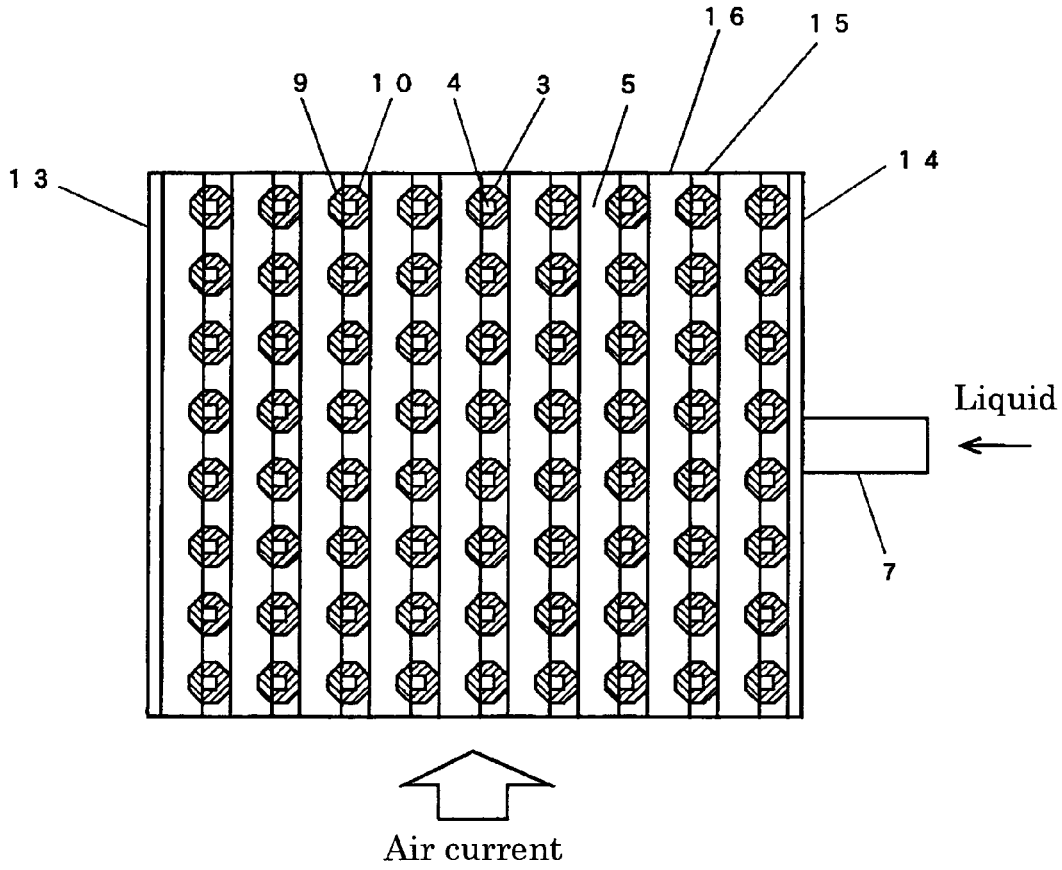
FIG. 8 is a sectional view of another heat exchanger in the direction orthogonal to the tube axis in accordance with exemplary embodiment 1.
Figure 9:
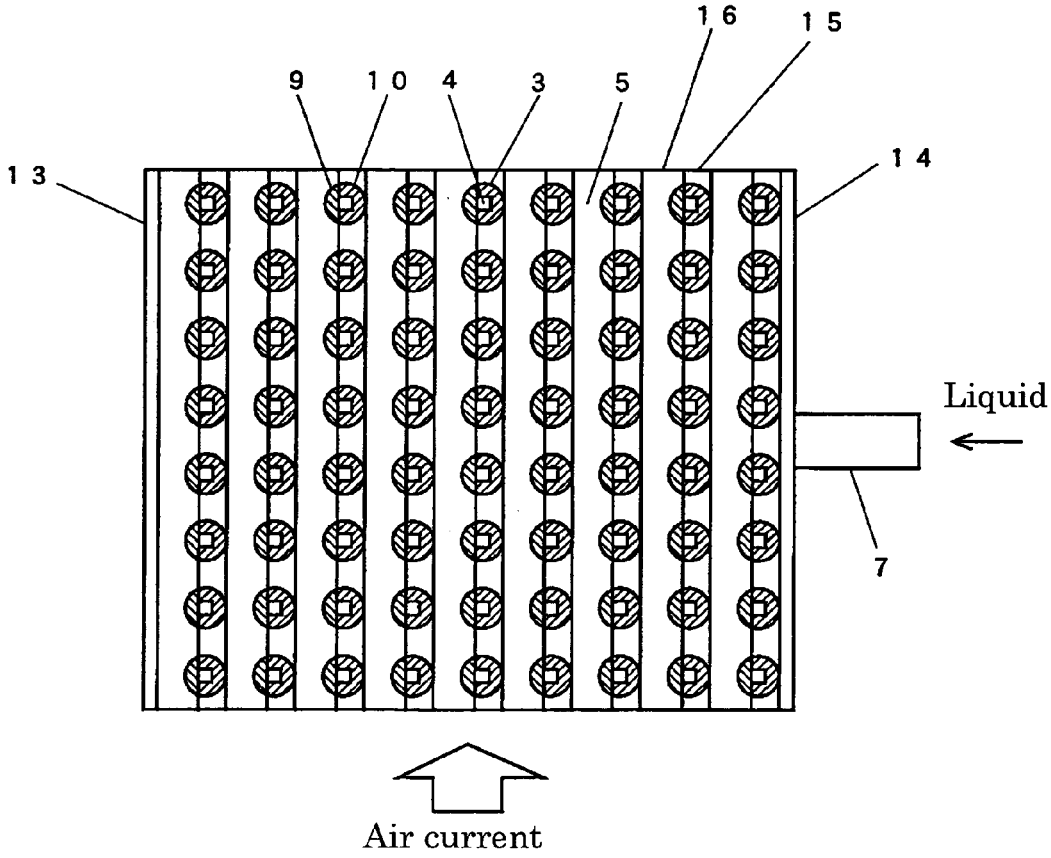
FIG. 9 is a sectional view of yet another heat exchanger in the direction orthogonal to the tube axis in accordance with exemplary embodiment 1.

The cross section shape of tubes 3 is a substantial square in the heat exchanger of embodiment 1; however, the cross section shape of tubes 3 may be another shape, for example, a substantial octagon shown in FIG. 8 or a substantial circle shown in FIG. 9.

Figure 10:
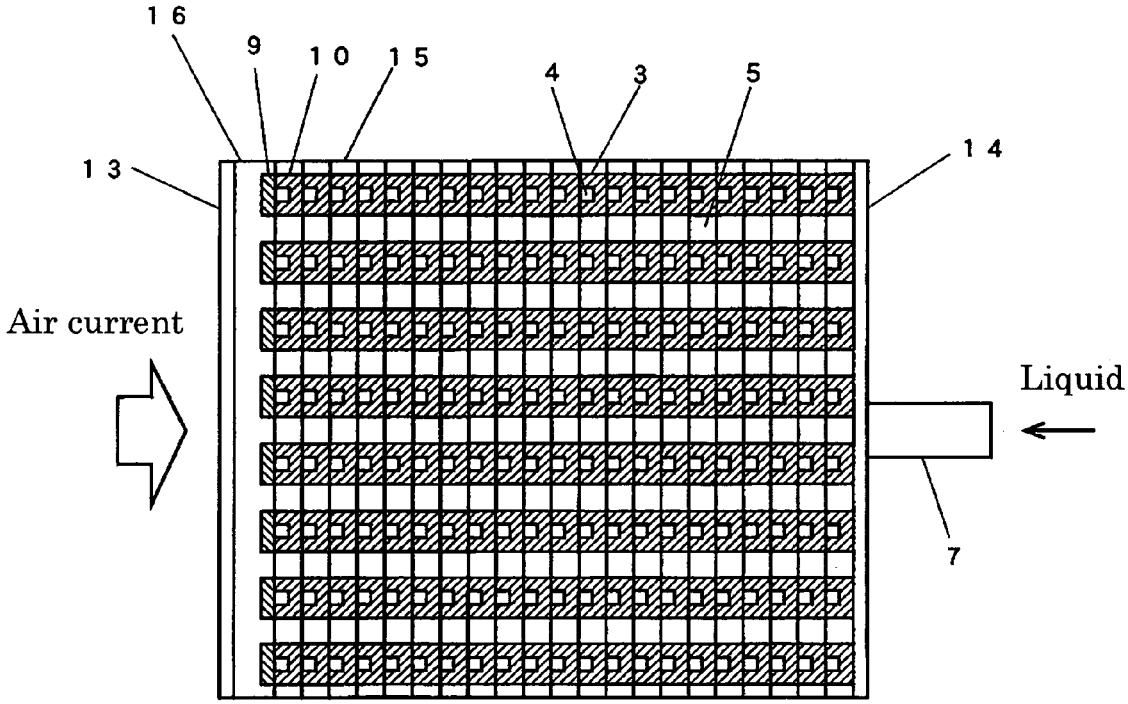
FIG. 10 is a sectional view of still another heat exchanger in the direction orthogonal to the tube axis in accordance with exemplary embodiment 1.

In the heat exchanger of embodiment 1, clearances between tubes 3 are disposed in the stacking state by alternately stacking substrates 15 and 16, and air current is made to flow in the plane direction of substrates 15 and 16. However, even when substrates 15 are continuously stacked to bring tubes 3 into contact with each other as shown in FIG. 10, for example, and air current is made to flow in the direction perpendicular to the plane of substrates 15, similar advantage can be obtained.

Second Exemplary Embodiment

Figure 11:
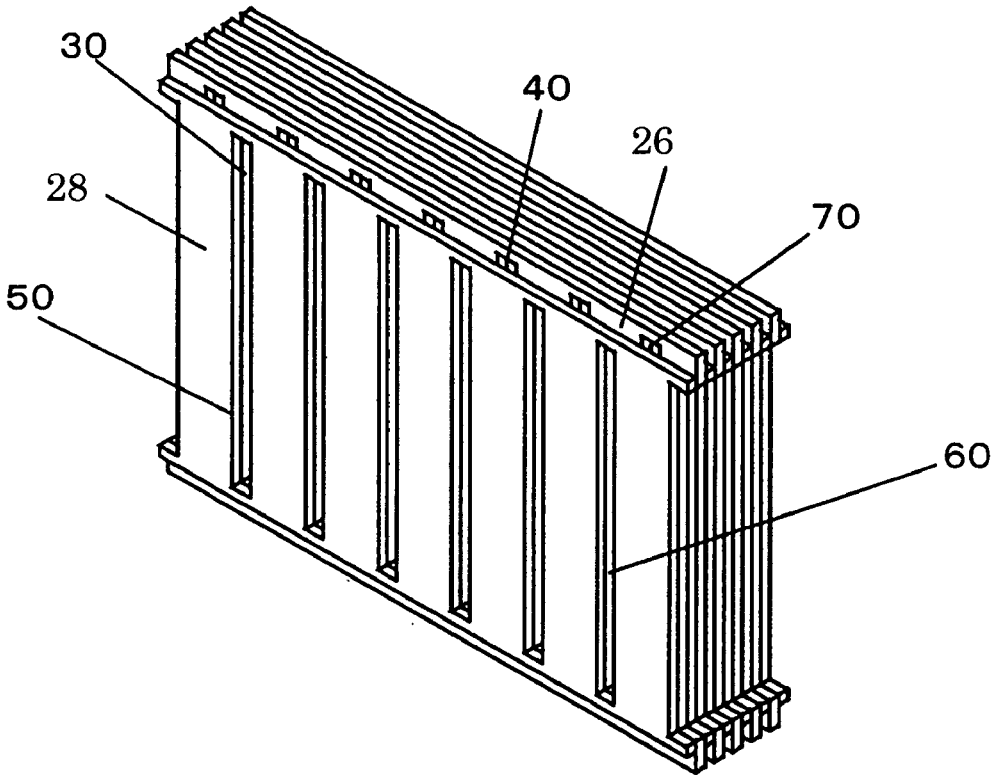
FIG. 11 is a perspective view of a heat exchanging section in accordance with exemplary embodiment 2 of the present invention.

FIG. 11 is a perspective view of a heat exchanging section in accordance with exemplary embodiment 2 of the present invention.

Figure 12:
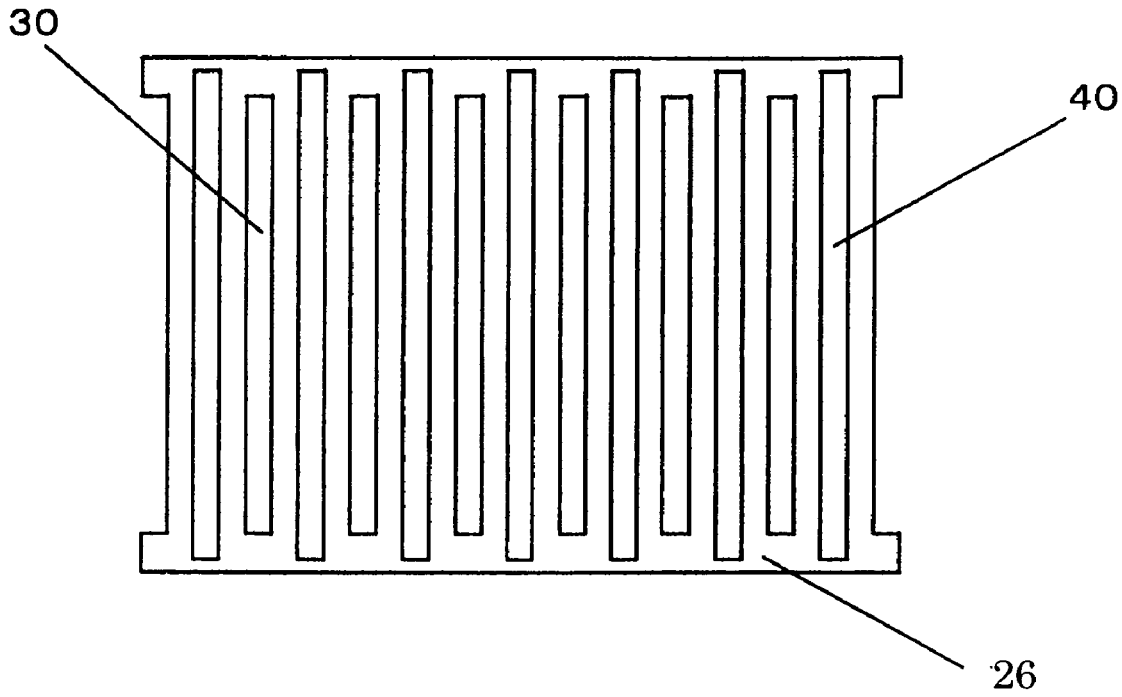
FIG. 12 is a front view of a first substrate in accordance with exemplary embodiment 2.
Figure 13:
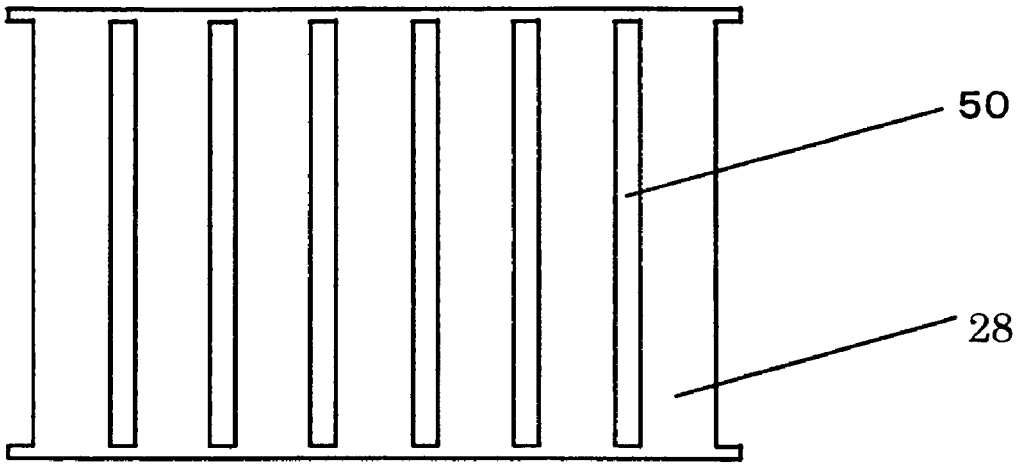
FIG. 13 is a front view of a second substrate in accordance with exemplary embodiment 2.

FIG. 12 is a front view of a first substrate in accordance with exemplary embodiment 2. FIG. 13 is a front view of a second substrate in accordance with exemplary embodiment 2. The heat exchanging section is formed by alternately stacking first substrates 26 and second substrates 28. A plurality of first slits 30 and a plurality of second slits 40 are alternately arranged substantially in parallel on each first substrate 26. Third slits 50 having the same shape as that of first slits 30 are disposed on each second substrate 28 at the same positions as the projection positions of first slits 30.

First slits 30 and third slits 50 overlap each other on the projection plane and communicate with each other, thereby forming tube external flow channels 60. The longitudinal size of third slits 50 disposed on second substrate 28 is shorter than that of second slits 40. Both longitudinal ends of second slits 40 are extended out of both ends of second substrates 28. Parts of second slits 40 except for the longitudinal both ends are sandwiched between second substrates 28 to form tube internal flow channels 70, and the longitudinal both ends of second slits 40 define inlets and outlets of tube internal flow channels 70. First substrates 26 and second substrates 28 are alternately stacked in embodiment 2. When a plurality of first substrates 26 are disposed between second substrates 28, however, the cross section of tube internal flow channels 70 can be increased.

When first substrates 26 are bonded to second substrates 28 by thermal welding, solder material is not required, the bonding can be performed by melting material, and hence a problem of leak of the solder material into tube internal flow channels 70 does not arise. Therefore, tube internal flow channels 70 can be prevented from being clogged. Especially, when ultrasonic bonding is employed, only the bonded part can be heated, and hence the quality and service life of the heat exchanger can be improved. When diffusion bonding is employed, the heating and pressurizing can be simultaneously applied until a temperature at which the material does not melt is obtained. Thus, atoms are diffused (mutually diffused), and the bonding can be performed by atom binding. In other words, when the bonding is performed by diffusion bonding, the melting of the material can be prevented, the clogging of tube internal flow channels 70 can be prevented, and hence the reliability of the heat exchanger is further improved.

When at least either first substrates 26 or second substrates 28 are molded by pressing, many substrates are molded relatively easily and hence the heat exchanger can be manufactured inexpensively. The interval between first slits 30 defining the walls of tube internal flow channels 70 and second slits 40 is made larger than the thickness of first substrates 26. Thus, a problem of twist of the walls of tube internal flow channels 70 by stress during pressing can be avoided, so that the production yield improves. Therefore, the heat exchanger can be manufactured inexpensively. When first substrates 26 and second substrates 28 are molded by etching, stress during molding of the slits can be eliminated or moderated, and hence a problem of twist of the walls of tube internal flow channels 70 can be avoided. Therefore, even when the walls of tube internal flow channels 70 are narrowed, the heat exchanger can be manufactured easily and inexpensively.

Figure 14:
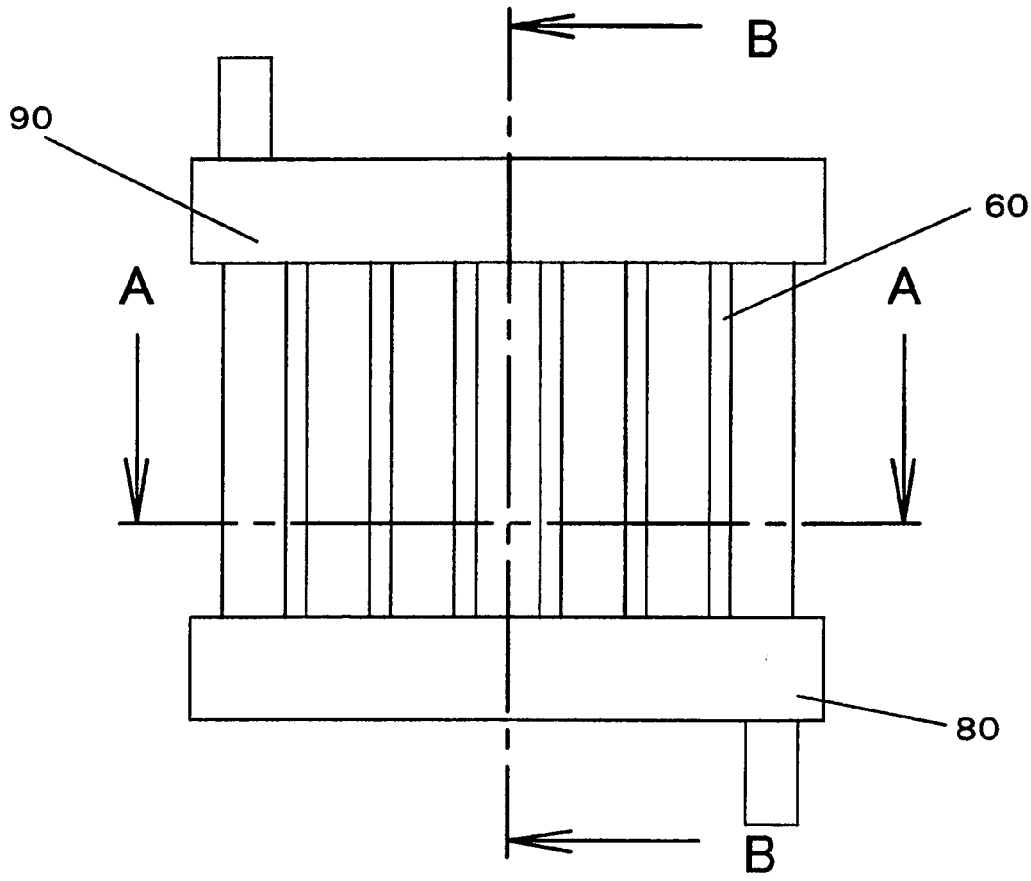
FIG. 14 is a front view of a heat exchanger in accordance with exemplary embodiment 2.
Figure 15:
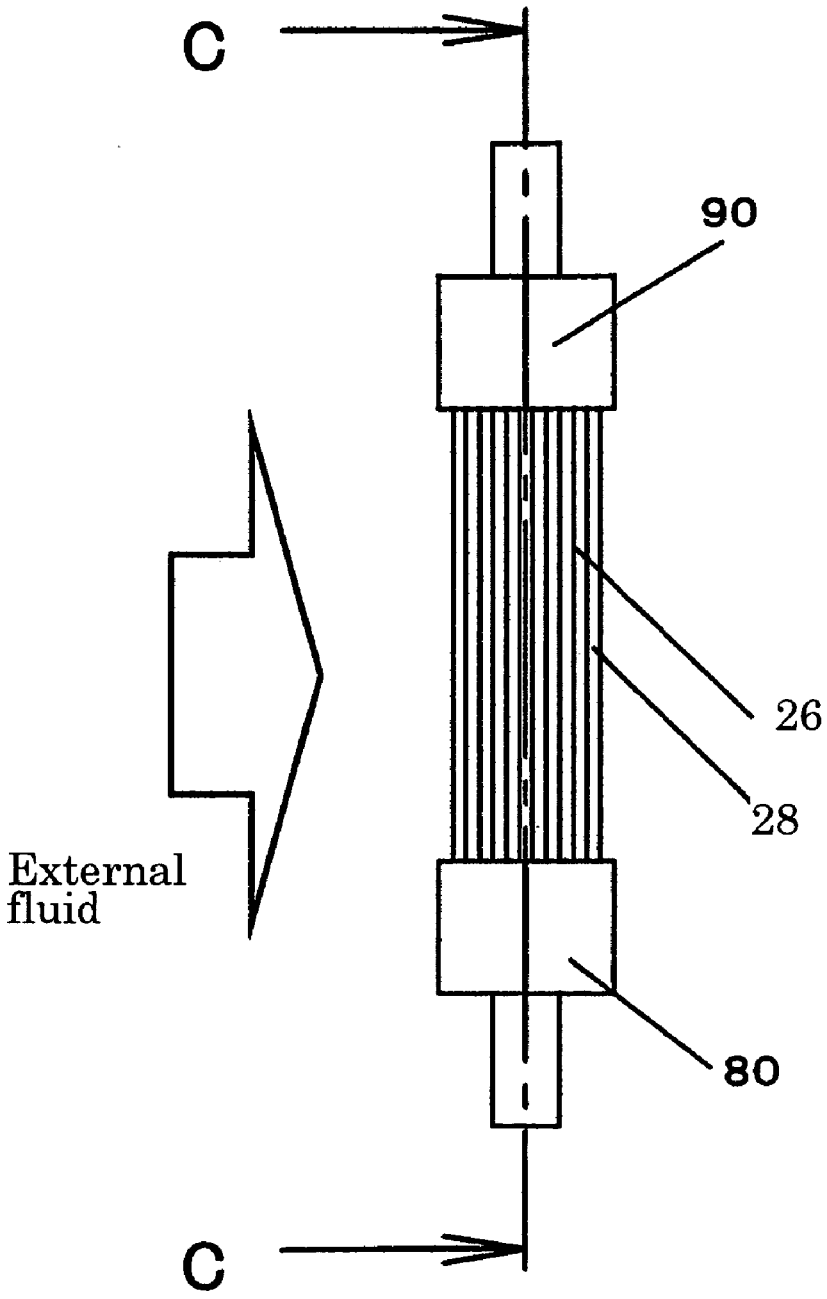
FIG. 15 is a side view of the heat exchanger in accordance with exemplary embodiment 2.
Figure 16:
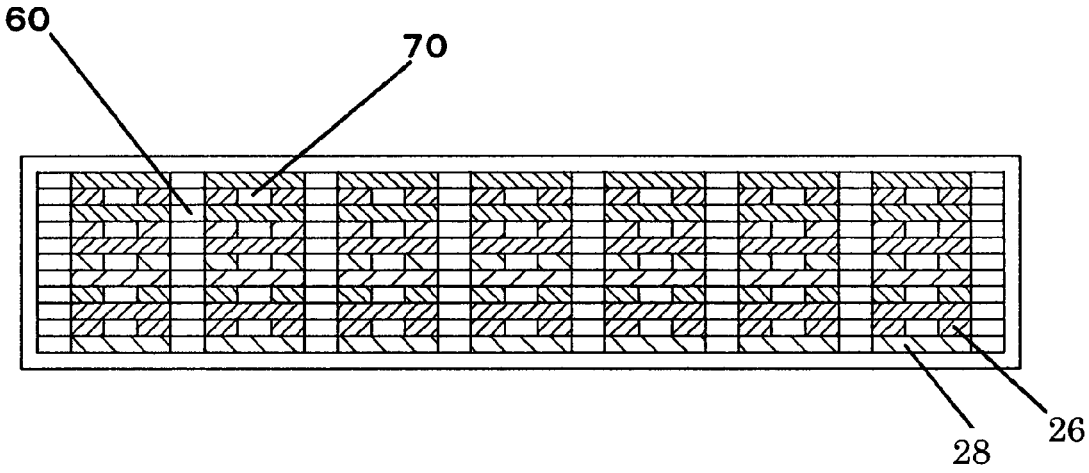
FIG. 16 is a sectional view taken in the line A-A of FIG. 14 in accordance with exemplary embodiment 2.
Figure 17:
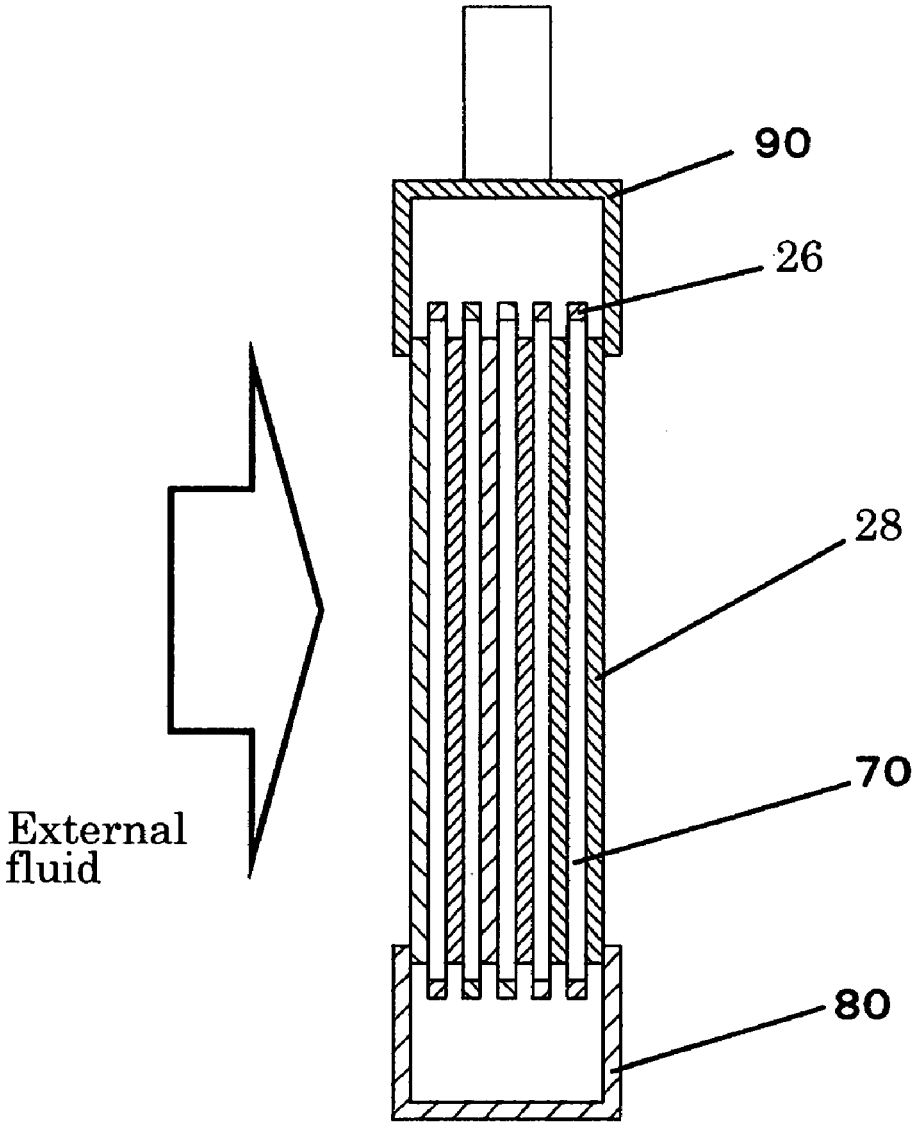
FIG. 17 is a sectional view taken in the line B-B of FIG. 14 in accordance with exemplary embodiment 2.
Figure 18:
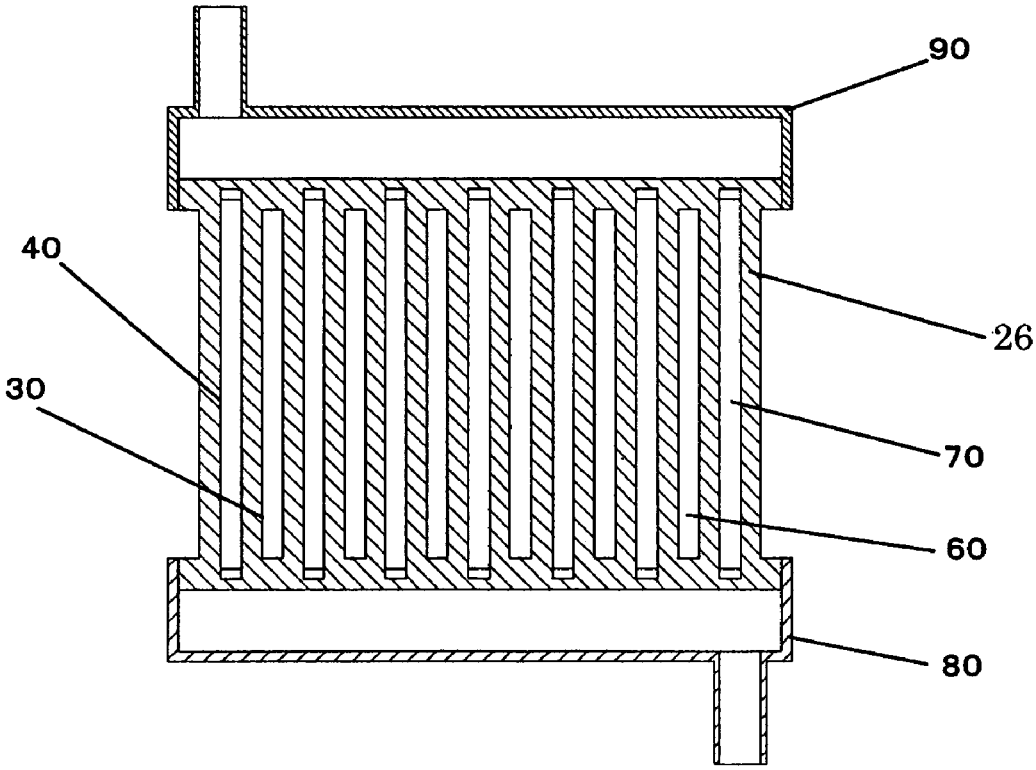
FIG. 18 is a sectional view taken in the line C-C of FIG. 15 of the heat exchanger in accordance with exemplary embodiment 2.

FIG. 14 is a front view of the heat exchanger in accordance with exemplary embodiment 2. FIG. 15 is a side view of the heat exchanger in accordance with exemplary embodiment 2. FIG. 16 is a sectional view taken in the line A-A of FIG. 14. FIG. 17 is a sectional view taken in the line B-B of FIG. 14. FIG. 18 is a sectional view taken in the line C-C of FIG. 15. Inlet header 80 and outlet header 90 of internal fluid are typically mounted to the opposite ends of the heat exchanging section. Inlet header 80 and outlet header 90 may be interchanged.

Operations of the heat exchanger having such a structure are described hereinafter. The internal fluid flowing from inlet header 80 is branched, flows in tube internal flow channels 70, and flows out of outlet header 90. External fluid flows in tube external flow channels 60 in the plane direction of first substrates 26 and second substrates 28. Heat is exchanged between the internal fluid and the external fluid in the heat exchanging section. The width of second slits 40 formed in first substrates 26 is made fine, and the interval between first slits 30 and second slits 40 is reduced, thereby narrowing the tubes. The pitch between tubes can be easily reduced by reducing the widths of first slits 30 and third slits 50, so that an extremely compact heat exchanger can be easily formed.

The heat exchanger of embodiment 2 has first substrates 26 where the plurality of first slits 30 and the plurality of second slits 40 are alternately arranged substantially in parallel, as discussed above. A plurality of second substrates 28 are stacked which have third slits 50 having substantially the same shape as that of first slits 30 at substantially the same positions as the projection positions of first slits 30 and are shorter than the longitudinal length of second slits 40. First slits 30 and third slits 50 form tube external flow channels 60. Second slits 40 and second substrates 28 between which second slits 40 are sandwiched form tube internal flow channels 70. In the heat exchanger of the present invention, a heat exchanging section that is conventionally formed of only tubes is formed of substrates having slits. This structure can be manufactured relatively easily, and the heat exchanger can be provided inexpensively.

In embodiment 2, at least either first substrates 26 or second substrates 28 can be manufactured by pressing, so that many substrates are easily and inexpensively manufactured and hence the heat exchanger can be provided inexpensively.

When first substrates 26 are bonded to second substrates 28 by thermal welding, solder material is not required and the bonding can be performed by melting material. Therefore, a problem of leak of the solder material into tube internal flow channels 70 does not arise, and hence tube internal flow channels 70 can be prevented from being clogged. Especially, when ultrasonic bonding is used, only the bonded part can be heated, and hence the quality and reliability of the heat exchanger can be improved. When diffusion bonding is employed, the heating and pressurizing can be simultaneously applied until a temperature at which the material does not melt is obtained. Thus, atoms are diffused (mutually diffused), and the bonding can be attained by atom binding. When the bonding is performed by diffusion bonding, the melting of the material is prevented, the clogging of tube internal flow channels 70 can be prevented, the reliability of the heat exchanger is further improved, the production yield is improved, and the heat exchanger can be provided inexpensively.

The heat exchanger where the plurality of first slits 30 and the plurality of second slits 40 are alternately arranged has been described in embodiment 2. Thus, tube external flow channels 60 and tube internal flow channel 70 are alternately arranged, so that heat exchanging efficiency is further improved and the whole region of the substrates can be efficiently used. However, the present invention is not limited to this embodiment. For example, a plurality of second slits 40 may be disposed between first slits 30, or a plurality of first slits 30 may be disposed between second slits 40.

As one design example, the region of a plurality of first slits 30 may be separated from the region of a plurality of second slits 40.

The shape of the heat exchanging section is not limited to the slit shape. Instead of first slits 30 and second slits 40, any slit shape expected to have the same advantage may be employed.

First slits 30 and second slits 40 are preferably arranged substantially in parallel from the viewpoints of the space factor or heat exchanging efficiency in forming the flow channels. However, arranging the slits substantially in parallel is not necessarily required, and the arrangement may be modified appropriately in response to design issues, a processing device, or an employed processing method of the heat exchanger.

Third Exemplary Embodiment

Figure 19:
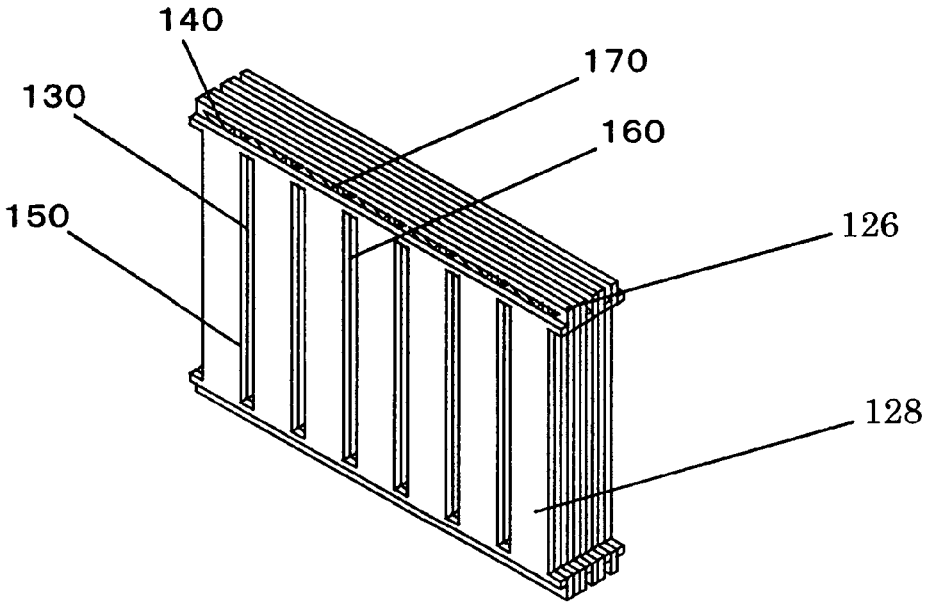
FIG. 19 is a perspective view of a heat exchanging section in accordance with exemplary embodiment 3 of the present invention.

FIG. 19 is a perspective view of a heat exchanging section in accordance with exemplary embodiment 3 of the present invention. The heat exchanging section is formed by stacking first substrates 126 and second substrates 128 so that first substrates 126 are sandwiched between second substrates 128. First slits 130 and third slits 150 form tube external flow channels 160 similarly to embodiment 2. Second slits 140 and second substrates 128 form tube internal flow channels 170. Three first substrates 126 are stacked between second substrates 128 on the inflow side of the external fluid, two first substrates 126 are stacked between them in the intermediate part, and one first substrate 126 is disposed between them on the outflow side thereof. Thus, tube internal flow channels 170 are enlarged in the substrate stacking direction on the inflow side of the external fluid.

Three rows of first substrates 126 are disposed in the flow direction of the external fluid in embodiment 3; however, the number of rows is not limited to three, but a plurality of rows may be disposed. The number of stacked first substrates 126 is changed to increase the length of tube internal flow channels 170 in the substrate stacking direction in embodiment 3; however, the thickness of stacked first substrates 126 may be changed to increase the length in the substrate stacking direction.

Figure 20:
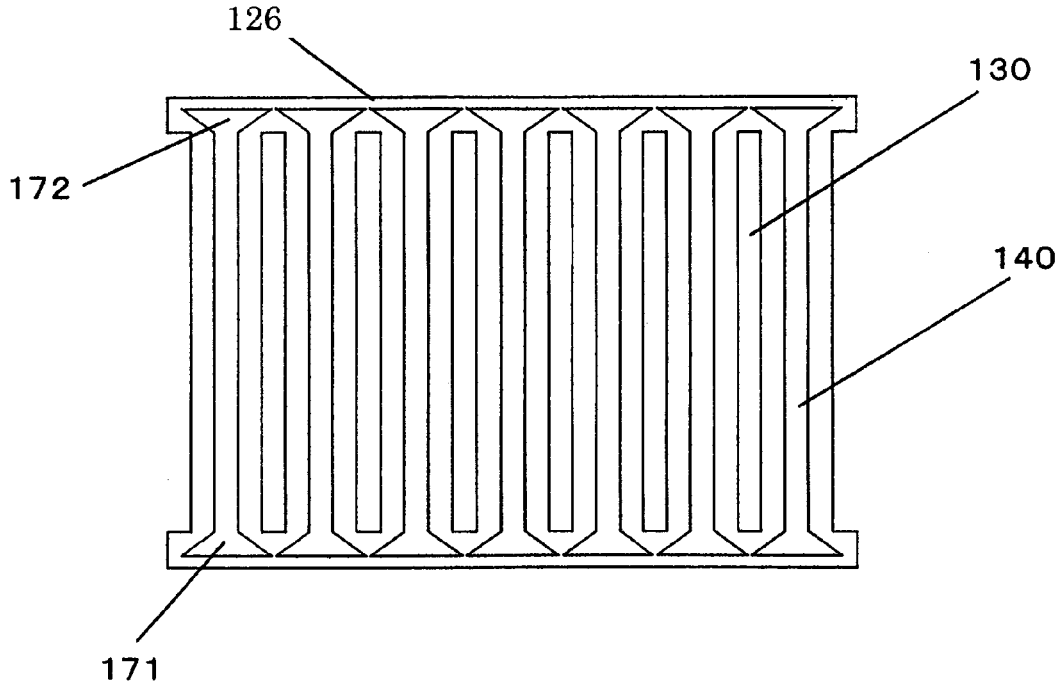
FIG. 20 is a front view of a first substrate in accordance with exemplary embodiment 3.
Figure 21:
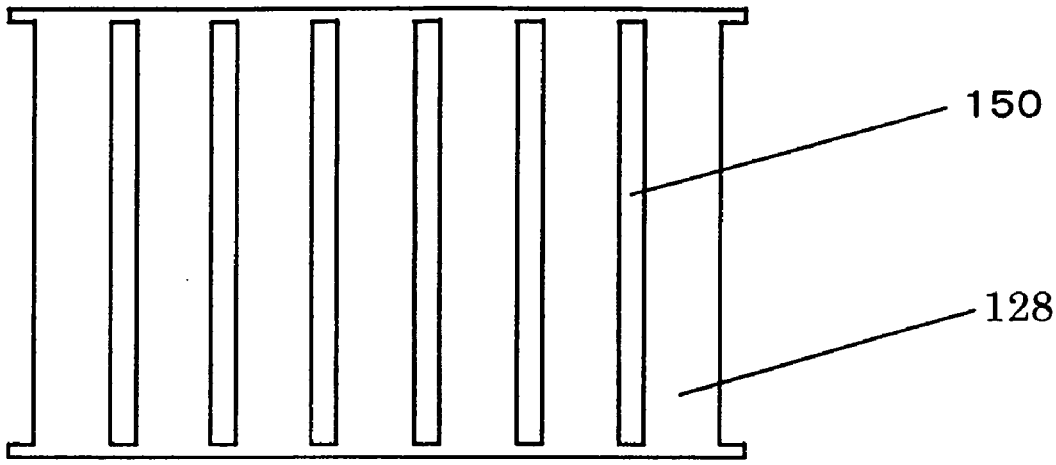
FIG. 21 is a front view of a second substrate in accordance with exemplary embodiment 3.

FIG. 20 is a front view of first substrate 126 in accordance with exemplary embodiment 3. FIG. 21 is a front view of second substrate 128. First substrate 126 has a plurality of first slits 130 and second slits 140 substantially in parallel. Inlet 171 and outlet 172 of the tube internal flow channel of each second slit 140 are extended in the direction of tube external flow channel 160. Second substrate 128 has third slits 150 with the same shape as that of first slits 130 at the same positions as the projection positions of first slits 130.

When first substrates 126 are bonded to second substrates 128 by thermal welding, solder material is not required and the bonding can be performed by melting material. The solder material does not leak into tube internal flow channels 170, and hence tube internal flow channels 170 can be prevented from being clogged. Especially, when ultrasonic bonding is employed, only the bonded part can be heated, and hence the quality and reliability of the heat exchanger are improved. When diffusion bonding is employed, by applying the heating and pressurizing simultaneously until a temperature at which the material does not melt is obtained, atoms are diffused (mutually diffused), and the bonding can be attained by atom binding. When the diffusion bonding is employed, the melting of the material can be prevented, the clogging of tube internal flow channels 170 can be prevented, and hence the reliability of the whole heat exchanger is further improved.

When first substrates 126 and second substrates 128 are molded by pressing, many substrates can be molded relatively easily and hence the heat exchanger can be manufactured inexpensively. The interval between first slits 130 defining walls of tube internal flow channels 170 and second slits 140 is made larger than the thickness of first substrates 126. Thus, twist of the walls of tube internal flow channels 170 by stress during pressing can be suppressed, so that the quality and the production yield of the heat exchanger improve. Therefore, the heat exchanger can be manufactured inexpensively. When at least either first substrates 126 or second substrates 128 are molded by etching, a problem of twist of the walls of tube internal flow channels 170 can be avoided. Therefore, even when the walls of tube internal flow channels 170 are narrowed, the heat exchanger can be manufactured easily and inexpensively.

Figure 22:
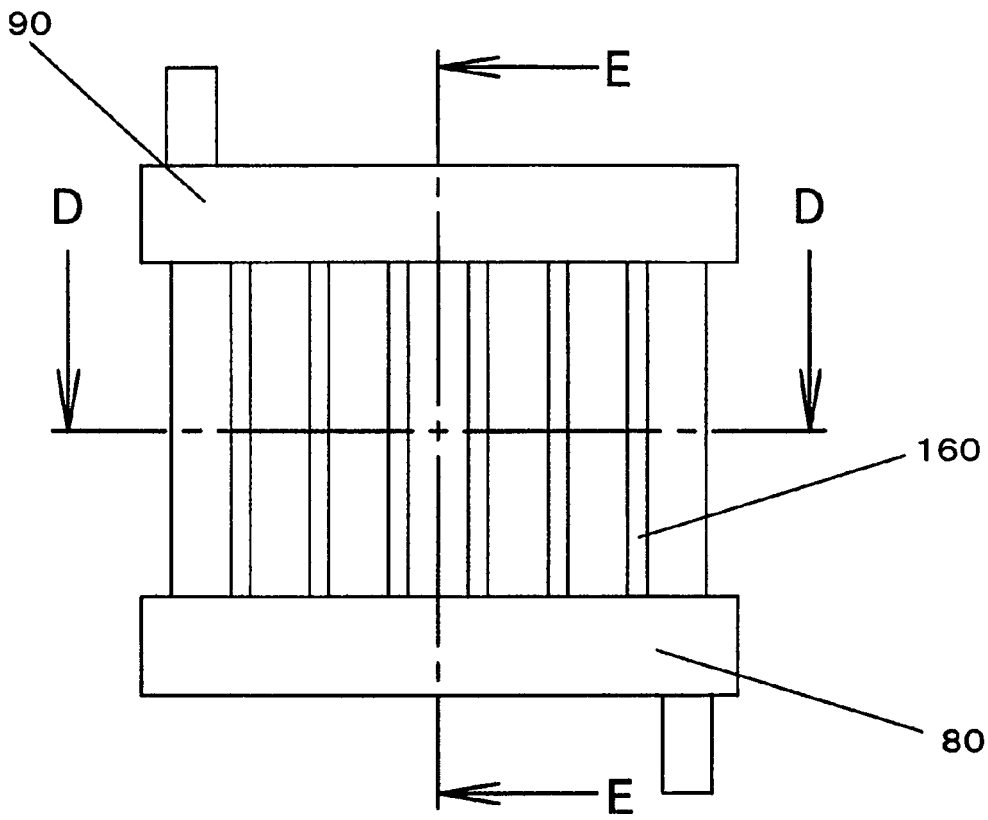
FIG. 22 is a front view of a heat exchanger in accordance with exemplary embodiment 3.
Figure 23:
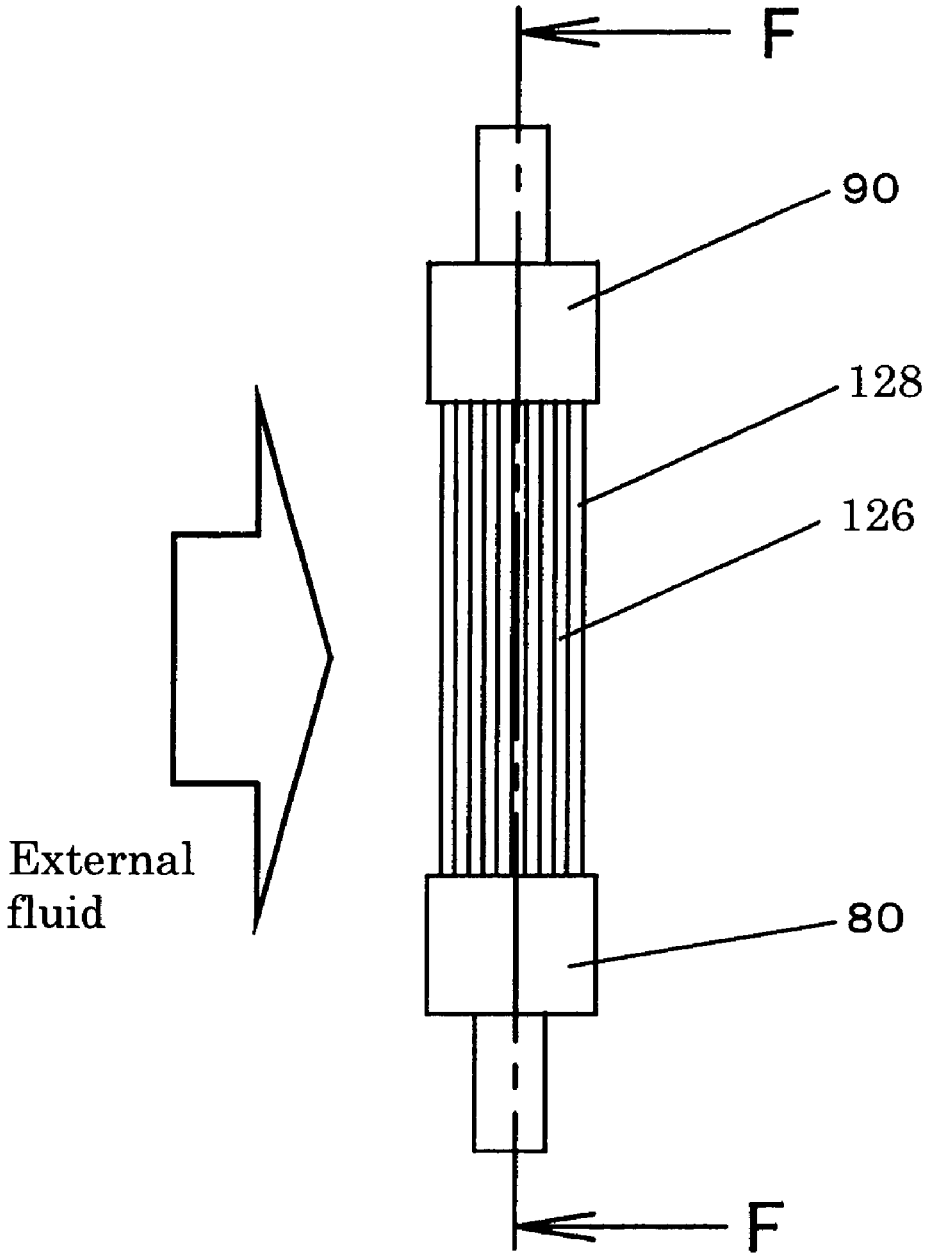
FIG. 23 is a side view of the heat exchanger in accordance with exemplary embodiment 3.
Figure 24:
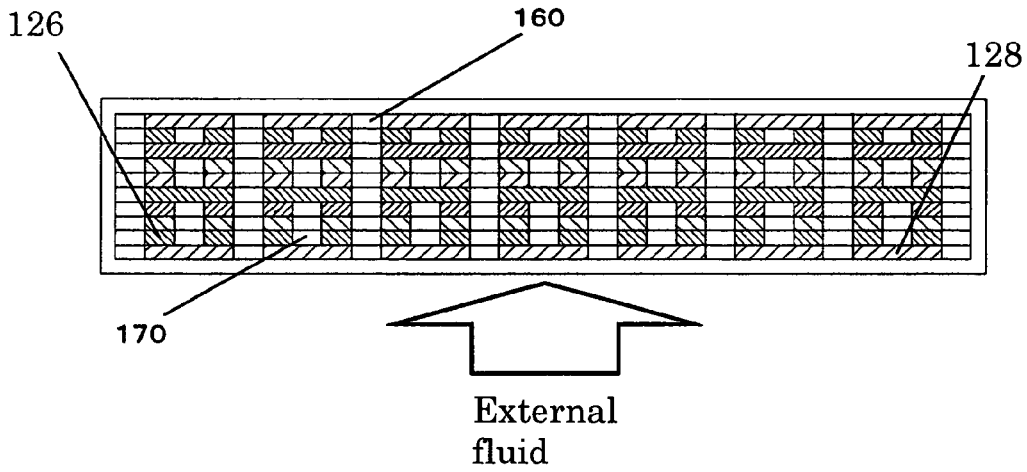
FIG. 24 is a sectional view taken in the line D-D of FIG. 22 in accordance with exemplary embodiment 3.
Figure 25:
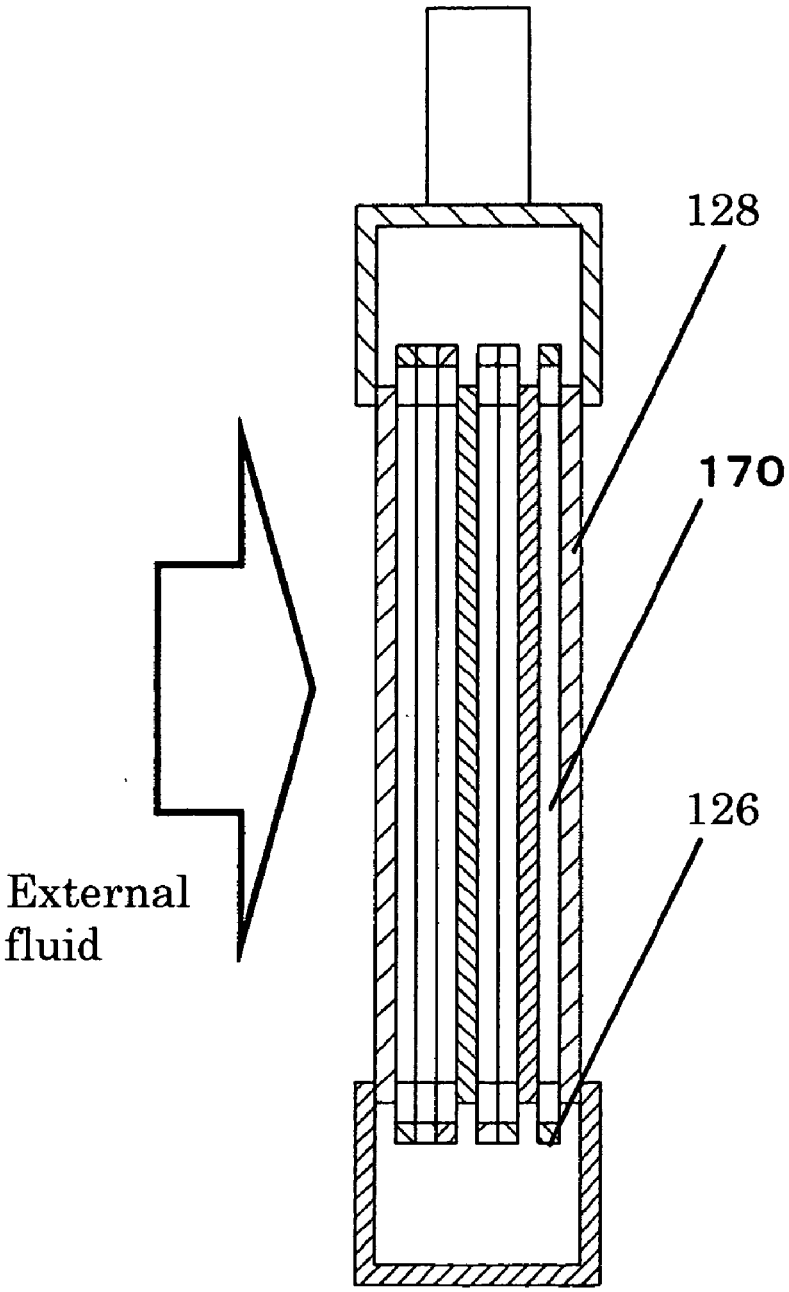
FIG. 25 is a sectional view taken in the line E-E of FIG. 22 in accordance with exemplary embodiment 3.
Figure 26:
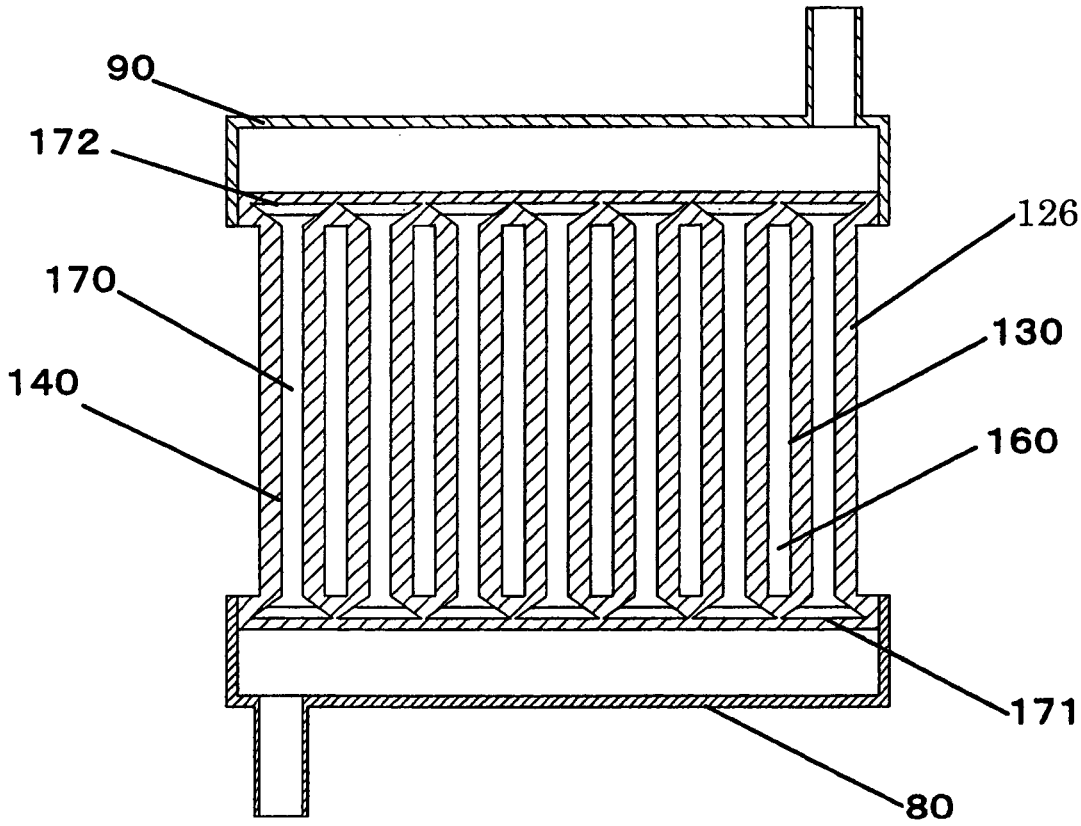
FIG. 26 is a sectional view taken in the line F-F of FIG. 23 in accordance with exemplary embodiment 3.

FIG. 22 is a front view of the heat exchanger in accordance with exemplary embodiment 3. FIG. 23 is a side view of the heat exchanger in accordance with exemplary embodiment 3. FIG. 24 is a sectional view taken in the line D-D of FIG. 22. FIG. 25 is a sectional view taken in the line E-E of FIG. 22. FIG. 26 is a sectional view taken in the line F-F of FIG. 23. Inlet header 80 and outlet header 90 of internal fluid are typically mounted to the opposite ends of the heat exchanging section. Inlet header 80 and outlet header 90 may be interchanged.

Operations of the heat exchanger having such a structure are described hereinafter.

The internal fluid flowing from inlet header 80 is branched, flows in tube internal flow channels 170 from inlets 171 of the tube internal flow channels, flows through outlets 172 thereof, and flows out of outlet header 90. At this time, since inlets 171 and outlets 172 of the tube internal flow channels are extended, the flow channel resistance can be decreased and the circulation amount of the internal flow can be increased even at the same pump power. Therefore, the heat exchanging mount is increased and the heat exchanger can be downsized. The heat exchanger can be therefore provided inexpensively. External fluid flows in tube external flow channels 160 in the plane direction of first substrates 126 and second substrates 128. Heat is exchanged between the internal fluid and the external fluid in the heat exchanging section. At this time, the number of stacked first substrates 126 is set larger to increase the length in the substrate stacking direction on the upstream side of the external fluid, on which temperature difference between the external fluid and the internal fluid is larger. Therefore, much internal fluid can be made to flow, the heat exchanging amount can be increased, and the heat exchanger can be downsized and provided inexpensively.

The heat exchanger of embodiment 3 includes first substrates 126 that have the plurality of first slits 130 and second slits 140 disposed substantially in parallel. Third slits 150 with substantially the same shape as that of first slits 130 are disposed at substantially the same positions as the projection positions of first slits 130. The plurality of second substrates 128 shorter than second slits 140 are stacked. In this structure, first slits 130 and third slits 150 form tube external flow channels 160, second slits 140 and second substrates 128 form tube internal flow channels 170. This structure is relatively simple, so that the heat exchanger can be manufactured easily and inexpensively.

Since tube internal flow channels 170 are enlarged in the substrate stacking direction on the inflow side of the external fluid, the temperature difference between the external fluid and the internal fluid is large, much internal fluid can be made to flow on the inflow side of the external fluid having large heat exchanging amount. Therefore, the heat exchanging amount can be increased, and the heat exchanger can be further downsized and provided inexpensively.

Since the number of first substrates 126 stacked between second substrates 128 is changed to vary the length of tube internal flow channels 170 in the substrate stacking direction, the heat exchanger can be manufactured easily and inexpensively.

Since inlets 171 and outlets 172 of tube internal flow channels 170 are extended in the direction of tube external flow channels 160, the opening areas of the inlet and outlet of the internal fluid can be increased. Thus, the tube internal resistance is decreased, the flow rate of the internal fluid is increased, hence the heat exchanging amount can be increased, and the heat exchanger can be downsized.

When at least either first substrates 126 or second substrates 128 are molded by pressing, many substrates can be molded relatively easily and hence the heat exchanger can be provided inexpensively. The interval between first slits 130 defining the walls of tube internal flow channels 170 and second slits 140 is made larger than the thickness of first substrates 126. Thus, a problem of twist of the walls of tube internal flow channels 170 by stress during pressing can be avoided, so that the heat exchanger having high quality and high production yield can be provided inexpensively. When at least either first substrates 126 or second substrates 128 are molded by etching, a problem of twist of the walls of tube internal flow channels 170 can be avoided. Therefore, even when the walls of tube internal flow channels 170 are narrowed, the heat exchanger can be manufactured easily and inexpensively.

When first substrates 126 are bonded to second substrates 128 by thermal welding, solder material is not required and the bonding can be performed by melting material. A problem of leak of the solder material into tube internal flow channels 170 does not arise, and hence tube internal flow channels 170 can be prevented from being clogged. Especially, when ultrasonic bonding is employed, only the bonded part can be heated, and hence the quality and reliability of the heat exchanger are improved. When diffusion bonding is employed, by applying the heating and pressurizing simultaneously until a temperature at which the material does not melt is obtained, atoms are diffused (mutually diffused), and the bonding can be attained by atom binding. When the diffusion bonding is employed, the melting of the material is prevented, the clogging of tube internal flow channels 170 can be prevented, the quality and reliability of the heat exchanger are further improved, and the heat exchanger having a long service life can be manufactured inexpensively.

INDUSTRIAL APPLICABILITY

A heat exchanger of the present invention and its manufacturing method can be attained inexpensively while extremely high heat exchanging performance is kept. The heat exchanger can be applied to a refrigerator-freezer, an air conditioner, or an exhaust heat recovery apparatus. The industrial applicability thereof is high.

The invention claimed is:

1. A heat exchanger, wherein a plurality of substrates are stacked, the plurality of substrate having: a plurality of long plates arranged in parallel, the long plates extending longitudinally; slits disposed between the long plates, the slits extending longitudinally and continuously; and recesses longitudinally and continuously disposed in one-side of main surfaces of some of the long plates, the recesses being disposed in parallel to the long plates and the slits, the long plates of the adjacent substrates are interconnected to form tubes, the recesses form tube internal flow channels, the slits form tube external flow channels, holding plates for holding the long plates at the both ends of the long plates and long holes formed inside the holding plates are disposed on the substrate, extensions of the recesses formed in one-side main surfaces of some of the long plates communicate with the long holes, the long holes in the adjacent substrates are interconnected to form branch flow channels, and the tube internal flow channels formed of the recesses are connected to the branch flow channels.

2. The heat exchanger of claim 1, wherein, substrates having a plurality of long plates arranged in parallel and slits disposed between the long plates, and other substrates having a plurality of long plates arranged in parallel, slits disposed between the long plates, and recesses disposed longitudinally continuously in one-side main surfaces of the long plates are alternately stacked.

3. The heat exchanger of claim 1 or claim 2, wherein, thickness of some of the long plates is set to be smaller than that of the holding plates, clearances are formed between the tubes also in a stacking direction of the substrates, and tube external flow channels are formed also between the substrates.

4. The heat exchanger of claim 3, wherein, fluid in the tube external flow channels is made to flow in a plane direction the substrates.

5. The heat exchanger of claim 1 or claim 2, wherein, the substrates are made of resin.

6. The heat exchanger of claim 1, wherein, lids for covering the long holes are, disposed at opposite ends of the stacked substrates, and part of the lids has one of an inflow tube and an outflow tube.

7. The manufacturing method of the heat exchanger of claim 1, wherein, the substrates are bonded and stacked by welding.

8. The heat exchanger of claim 1, wherein liquid flows longitudinally in the tube internal flow channel formed by the recesses.

9. The heat exchanger of claim 1, wherein only one slit is disposed between the long plates.

10. The heat exchanger of claim 9, wherein the substrates are bonded and stacked by welding.

11. The heat exchanger of claim 9, wherein liquid flows longitudinally in the tube internal flow channel formed by the recesses.

* * * * *